US006546837B1

(12) United States Patent
Neyer

(10) Patent No.: US 6,546,837 B1
(45) Date of Patent: Apr. 15, 2003

(54) DUAL LOAD CHARGE MANUFACTURING METHOD AND PRESS THEREFORE

(75) Inventor: Barry T. Neyer, Cincinnati, OH (US)

(73) Assignee: PerkinElmer, Inc., Wellesley, MA (US)

( * ) Notice: Subject to any disclaimer, the term of this patent is extended or adjusted under 35 U.S.C. 154(b) by 0 days.

(21) Appl. No.: 10/002,550

(22) Filed: Nov. 2, 2001

(51) Int. Cl.[7] ..... F42B 3/08

(52) U.S. Cl. ..... 86/20.1; 86/20.11; 86/29; 86/30

(58) Field of Search ..... 86/20.1, 20.11, 86/20.12, 20.15, 21, 29, 30; 29/4, 33 C; 72/367.1, 370.1, 396, 398; 425/352

(56) References Cited

U.S. PATENT DOCUMENTS

| | | | | | |
|---|---|---|---|---|---|
| 3,570,403 | A | * | 3/1971 | Hawley et al. | 102/202.9 |
| 3,742,859 | A | * | 7/1973 | Finnegan et al. | 149/14 |
| 3,807,466 | A | * | 4/1974 | Minneman | 141/332 |
| 3,903,800 | A | * | 9/1975 | Kilmer | 102/275.8 |
| 3,943,017 | A | * | 3/1976 | Wells | 149/19.8 |
| 3,978,046 | A | * | 8/1976 | Coon | 540/474 |
| 4,450,124 | A | * | 5/1984 | Christmann et al. | 102/476 |
| 4,455,914 | A | * | 6/1984 | Christmann et al. | 102/476 |
| 4,791,532 | A | * | 12/1988 | Gouvernelle et al. | 29/25.03 |
| 4,831,933 | A | | 5/1989 | Nerheim et al. | |
| 4,862,803 | A | | 9/1989 | Nerheim et al. | |
| H775 | H | * | 5/1990 | Rouse et al. | 102/334 |
| 5,094,166 | A | | 3/1992 | Hendley, Jr. | |
| 5,094,167 | A | | 3/1992 | Hendley, Jr. | |
| 5,233,929 | A | * | 8/1993 | Spahn | 102/305 |
| 5,251,530 | A | * | 10/1993 | Kaeser | 102/476 |
| 5,347,907 | A | * | 9/1994 | Strandli et al. | 102/518 |
| 5,509,356 | A | * | 4/1996 | Renfro | 102/307 |
| 5,520,114 | A | | 5/1996 | Guimard et al. | |
| 5,756,925 | A | * | 5/1998 | Frank et al. | 102/202.14 |
| 6,158,347 | A | | 12/2000 | Neyer et al. | |

OTHER PUBLICATIONS

Depts. of the Army and Air Force, TM 9–1910/TO 11A–1–34, Apr. 1955, (Reprint Dec. 1957), p. 181.*

* cited by examiner

*Primary Examiner*—Charles T. Jordan
*Assistant Examiner*—Bret Hayes
(74) *Attorney, Agent, or Firm*—Iandiorio & Teska; Kirk Teska; R. Stephen Rosenholm

(57) ABSTRACT

A method of manufacturing a dual load charge in a single consolidation pressing operation. A first type explosive is placed in a cavity to form a booster charge. A pocket is formed in the booster charge. A second type explosive is disposed in the pocket of the booster charge to form an initiating charge therein. Finally, the booster charge and the initiating charge are preferably simultaneously consolidated to form a dual load charge with intimate contact between the booster charge and the initiating charge. Also disclosed is a press useful for implementing the method of the invention.

19 Claims, 4 Drawing Sheets

DUAL LOAD CHARGE MANUFACTURING METHOD AND PRESS THEREFORE

FIELD OF THE INVENTION

This invention relates to dual load type detonators, a method of manufacturing a dual load pellet in a single consolidation pressing operation, and a press used in accordance with the method. Dual load type detonators can be used in military, mining, automotive, and construction applications.

BACKGROUND OF THE INVENTION

Detonators are typically used to detonate an explosive charge. Sometimes, initiators, such as exploding foil initiators, are used to set off the detonator. Many detonators require two explosive loads to meet certain design requirements. This is because some explosives, such as 2,2',4,4',6,6'-Hexanitrostilbene (HNS), are reliably initiated, but have a relatively weak output. Other types of explosives have a stronger output but are more difficult to reliably initiate. One example includes octahydro-1,3,5,7-tetranitro-1,3,5,7-tetrazocine (HMX).

Thus, some detonators include an initiating charge made of HNS which detonates a booster charge made of HMX. Since the powder used for the initiating charge is often relatively expensive, steps are taken to insure that only a minimum amount of this type powder is used.

In the prior art, such dual load detonators were fabricated by independently forming a pellet of HNS, independently forming a pellet of HMX, and then coupling the two pellets together using adhesives and/or mechanical fixtures.

In forming each pellet, controlling the density of the resulting pellet is critical. In a normal pressing operation, the required amount of explosive powder is weighed and placed into a pressing fixture. A high pressure of 1,000–30,000 lbs is applied to the fixture causing the compaction of the explosive powder. In some instances, the density is controlled by pressing to a specific pressure while in other instances the density is controlled by pressing a fixed amount of explosive into a known volume (also called pressing to a stop). Controlling the density is important because variations in density can cause variations in initiation sensitivity and in the output of the detonator.

In the prior art where each pellet is separately consolidated, controlling the density of each pellet can be a time consuming process. Moreover, it can be difficult to reliably couple the two pellets together.

SUMMARY OF THE INVENTION

It is an object of this invention to provide a less expensive dual load charge detonator by using only a minimum required amount of the expensive initiating charge powder.

It is a further object of this invention to provide a more robust charge wherein the initiating charge is in intimate contact with the booster charge.

It is a further object of this invention to eliminate the need for adhesives or mechanical fixtures previously used to couple two independently pressed pellets.

It is a further object of this invention to provide a method of simultaneously consolidating a dual load charge.

It is a further object of this invention to provide such a method which cuts the consolidation time in half by simultaneously consolidating both charges in a single consolidating pressing step.

It is a further object of this invention to provide a press for manufacturing a dual load charge in a single consolidation pressing operation.

The invention results from the realization that the expense associated with the initiating charge can be reduced, the time associated with separately consolidating the initiating charge and the booster charge can be cut in half, and that a more robust dual load pellet or charge can be manufactured by simultaneously consolidating both the booster charge and the initiating charge.

This invention features a method of manufacturing a dual load charge typically in a single consolidation pressing operation. The method comprises placing a first type explosive into a cavity to form a booster charge; forming a pocket in the booster charge; disposing a second type explosive in the pocket of the booster charge to form an initiating charge therein; and preferably simultaneously consolidating both the booster charge and the initiating charge thereby forming a dual load charge with intimate contact between the booster charge and the initiating charge.

In one example, the cavity is in a detonator housing (e.g. a transistor can) and the dual load charge is left in the cavity. In another example, the cavity is in a female mold member and the dual load charge is removed from the female mold member as a pellet. In the preferred embodiment, the first type explosive is octahydro-1,3,5,7-tetranitro-1,3,5,7-tetrazocine and the second type explosive is 2,2',4,4',6,6'-Hexanitrostilbene (HNS).

This invention also features a press for manufacturing a dual load charge preferrably in a single consolidation pressing operation. The press comprises an outer press having a working surface and a channel therethrough, the outer press receivable in a cavity; a first inner press receivable in the channel of the outer press, the first inner press having a working surface which extends beyond the working surface of the outer press; and a second inner press receivable in the channel of the outer press, the second inner press having a working surface which is flush with the working surface of the outer press.

In the preferred embodiment, the outer press further includes a funnel-shaped portion in communication with the channel for loading the cavity with an explosive through the channel when the outer press is placed in the channel.

The preferred method of manufacturing a dual load pellet in a single consolidation pressing operation, in accordance with this invention includes placing a first type explosive in a cavity to form a booster charge and then forming a pocket in the booster charge. The pocket is formed by disposing an outer press having a working surface and a channel therethrough in the cavity in combination with a first inner press receivable in the outer press. The first inner press has a working surface which extends beyond the working surface of the outer press in order to form the pocket. Then, a second type explosive is disposed in the pocket to form an initiating charge. In this step, the first inner press is removed and the second type explosive is poured into the channel of the outer press. Finally, a second inner press is placed in the channel of the outer press. The second inner press has a working surface which is flush with the working surface of the outer press. By applying pressure to the second inner press, both the booster charge and the initiating charge are simultaneously consolidated thereby forming a dual load pellet with intimate contact between the booster charge and the initiating charge.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
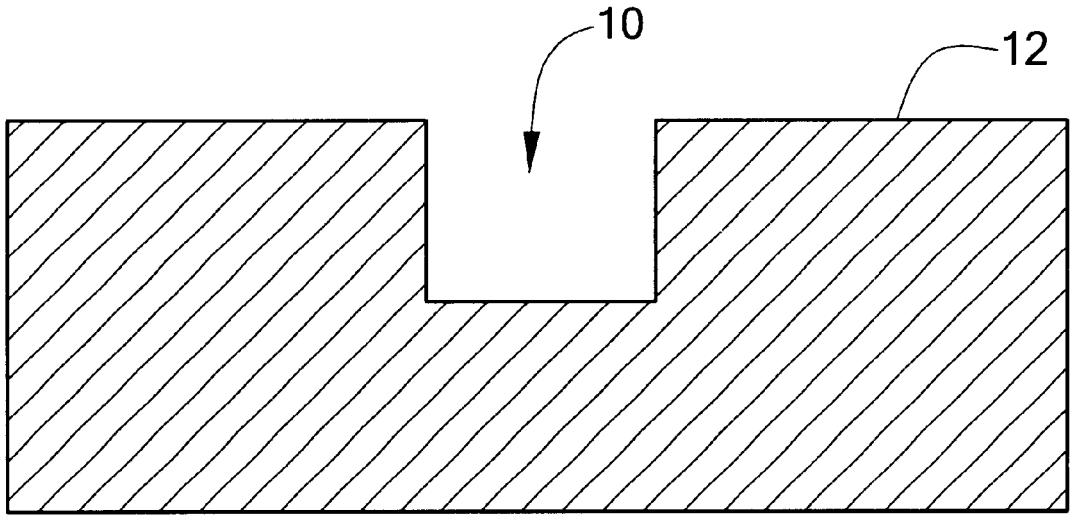
FIG. 1 is a schematic cross-sectional view of a cavity formed in a female mold body or, alternatively, the cavity of a detonator housing.
Figure 2:
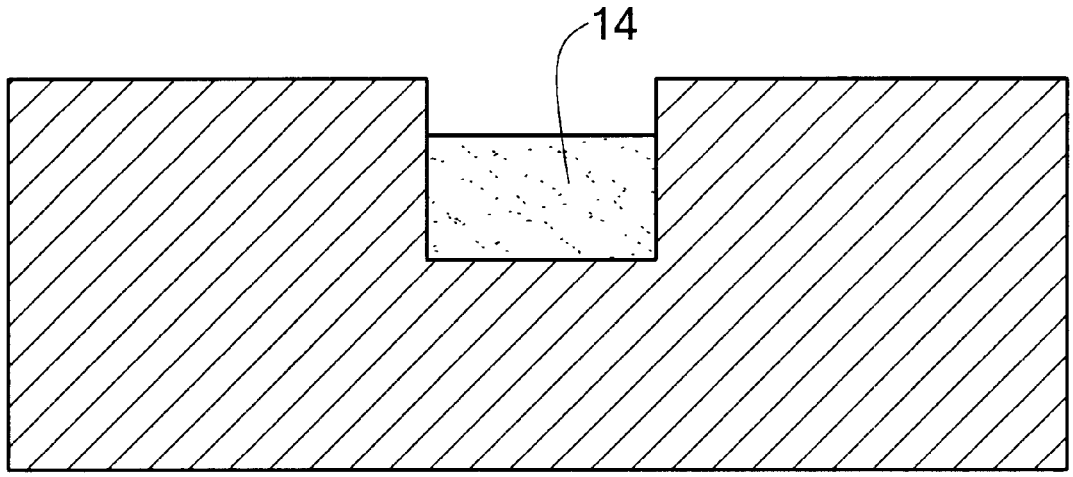
FIG. 2 is a schematic cross-sectional view showing how the cavity shown in FIG. 1 is filled with a booster charge in accordance with the method of the subject invention.

The method of manufacturing a dual load charge in a single consolidation pressing operation in accordance with this invention and the novel press associated therewith are shown in FIGS. 1–7. Cavity 10 in a female mold body or detonator housing 12 is shown in FIG. 1. A first type (booster or output) explosive is placed in cavity 10 as shown in FIG. 2 to form booster charge 14. In one example, 320 grams of octahydro-1,3,5,7-tetranitro-1,3,5,7-tetrazocine (HMX) were poured into cavity 10, FIG. 1, 0.3 inches in diameter and 0.15 inches high. The amount of the HMX used and the size of cavity 10, however, can vary depending on the specific design criteria.

Figure 3:
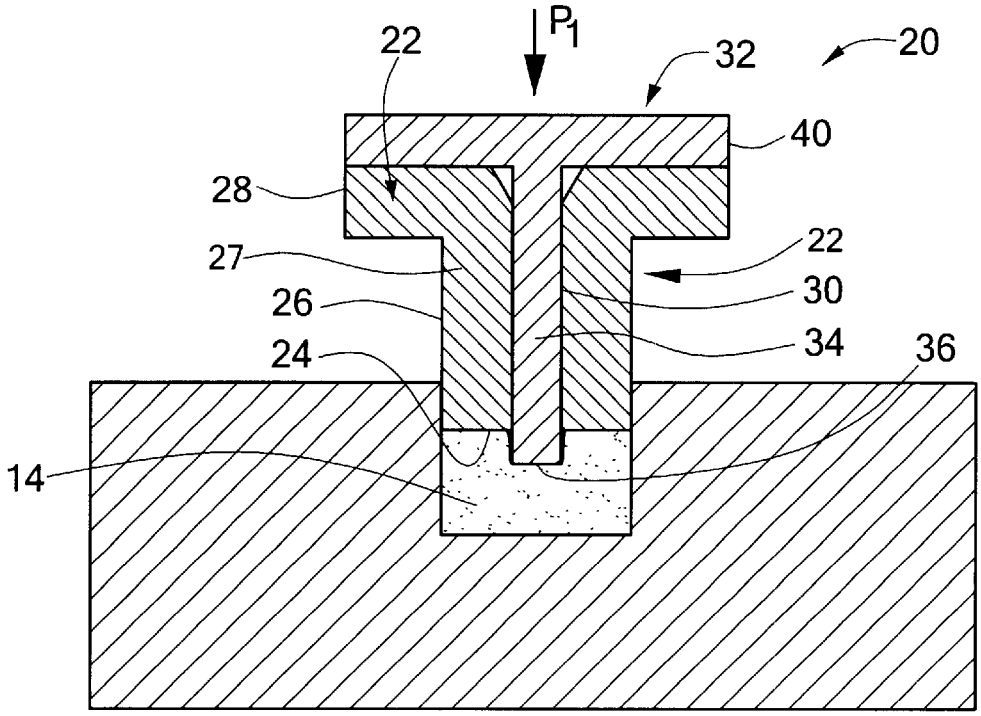
FIG. 3 is a schematic cross-sectional view depicting how the press of the subject invention is used to mold the booster charge powder into a rough shape and form a pocket therein in accordance with the subject invention.

Next, press 20, FIG. 3, is used to mold the HMX powder in cavity 10 into a rough shape. Press apparatus 20 includes outer press 22 having working surface 24 at the distal end of stem 26. The proximal end of stem 26 terminates in head 28. Channel 30 extends through outer press 22 along its longitudinal axis. Stem 34 of first inner press 32 is shown positioned in channel 30 and terminates at its distal end at working surface 36 which extends beyond working surface 24 of outer press 22. In one example, working surface 36 of first inner press 32 was 0.080 inches in diameter and extended 0.080 inches beyond working surface 24 of outer press 22 which was 0.3 inches in diameter. A pressure $P_1$ of 100 psi was applied to head portion 40 of inner press 32 and the proximal end of stem 34. In another example, a higher pressure is used and the HMX powder is more fully consolidated.

Figure 4:
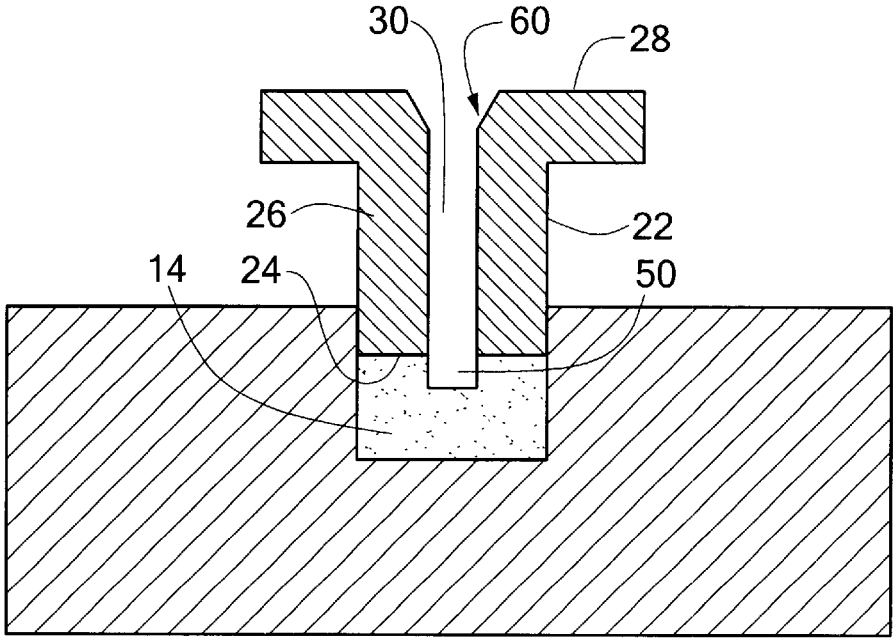
FIG. 4 is a schematic cross-sectional view showing how the first inner press of the subject invention is removed from the outer press so that an initiating charge can be poured into the pocket formed in the booster charge via the channel through the outer press in accordance with the method of the subject invention.
Figure 5:
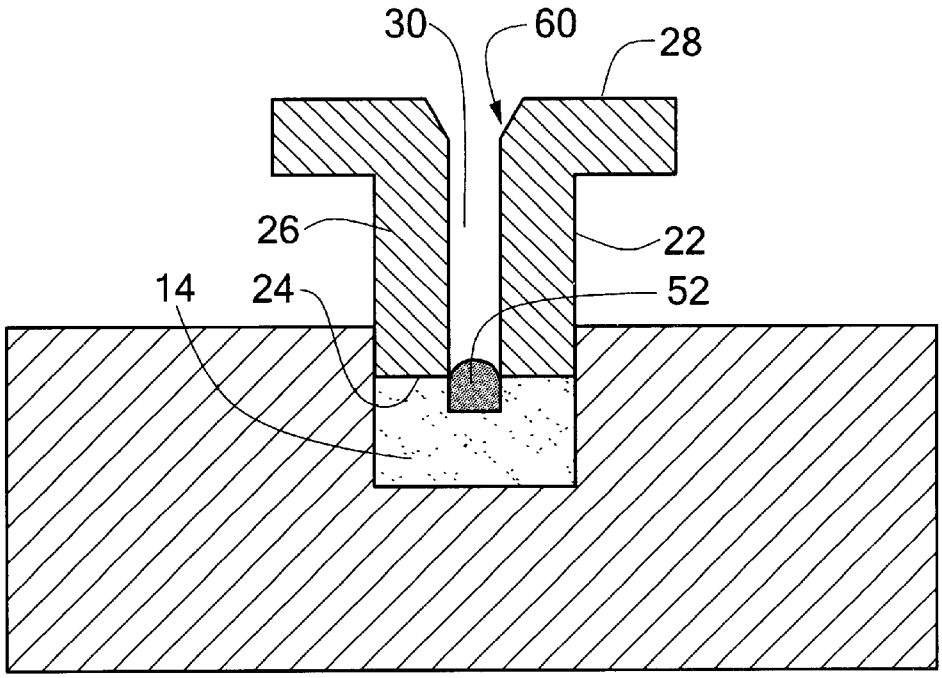
FIG. 5 is a schematic cross-sectional view showing the pocket formed in the booster charge filled with the initiating charge in accordance with the method of the subject invention.

The result is the formation of pocket 50, FIG. 4, in booster charge 14. First inner press 32, FIG. 3 is now removed and a second type explosive 52, FIG. 5, is disposed in pocket 50, FIG. 4 by pouring the second type explosive powder in channel 30. As shown in FIGS. 4 and 5, channel 30 widens at head portion 28 of outer press 22 forming funnel shaped orifice 60 which helps direct the second type explosive into channel 30. Typically, the first type explosive is an explosive such as octahydro-1,3,5,7-tetranitro-1,3,5,7-tetrazocine (HMX) that has a strong output but is difficult to reliably initiate and the second type explosive is that type of explosive, such as 2,2',4,4',6,6'-Hexanitrostilbene (HNS), which can be reliably initiated, but has a relatively weak output. In one example, 10 grams of HNS were poured into pocket 50, FIGS. 4–5.

Figure 6:
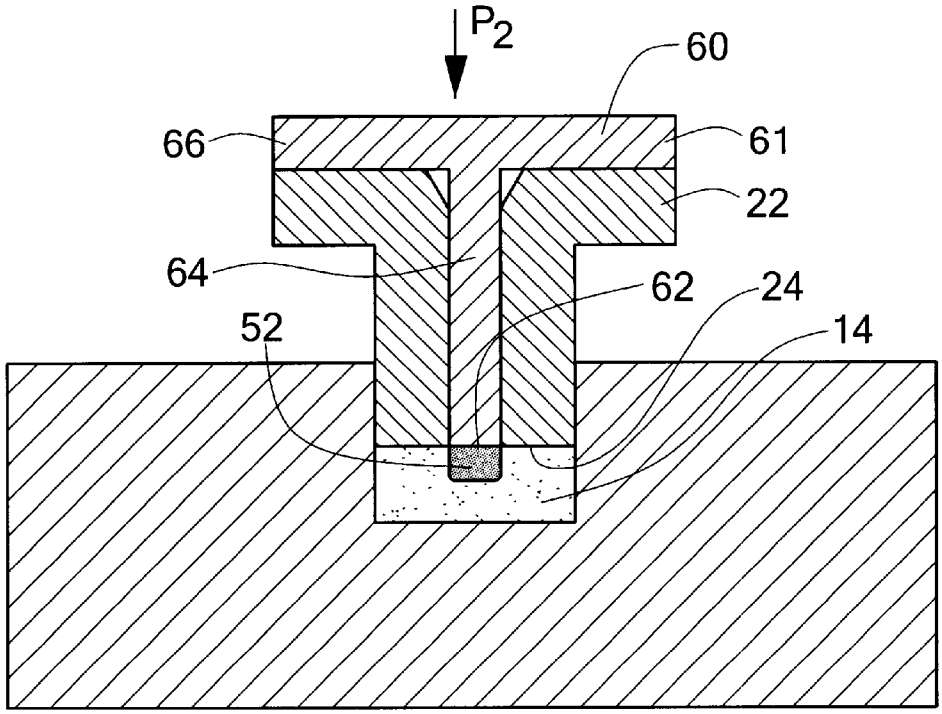
FIG. 6 is a schematic cross-sectional view depicting the use of a second inner press in accordance with subject invention placed in the outer press in order to simultaneously consolidate both the booster charge and the initiating charge in accordance with the method of the subject invention.

Next, second inner press 61, FIG. 6 with working surface 62 at the distal end of stem 64, which is flush or nearly flush with working surface 24 of outer press 22, is inserted in channel 30, FIG. 5 of outer press 22. A pressure $P_2$ is then applied to head portion 66 of second inner press 61 to simultaneously consolidate both booster charge 14 and initiating charge 52 thereby forming dual load charge 70, FIG. 7 wherein booster charge 14 is in intimate contact with initiating charge 52. In one example, pressure $P_2$ was 20,000 psi.

Figure 7:
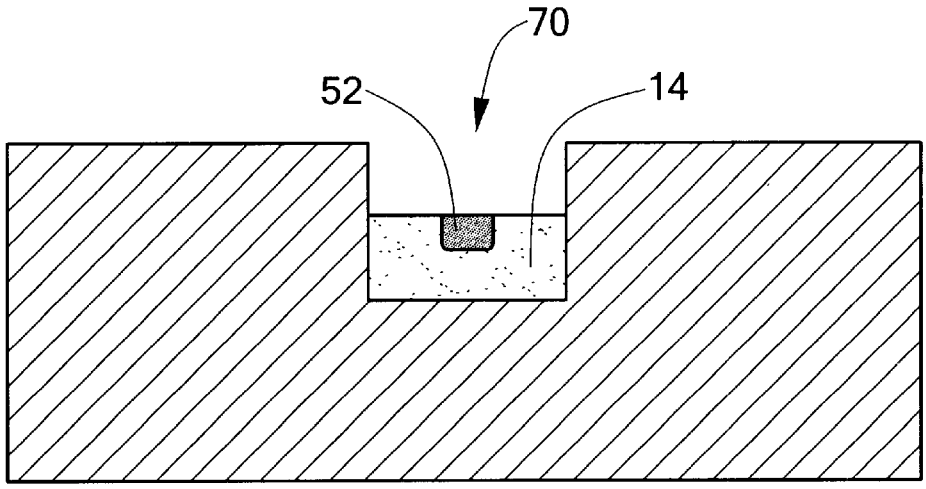
FIG. 7 is a schematic cross-sectional view showing the consolidated dual load charge manufactured in accordance with the subject invention.
Figure 8:
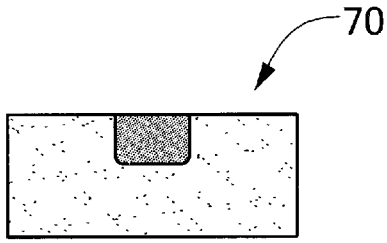
FIG. 8 is a schematic cross-sectional view showing, in one embodiment, how the dual load charge is removed from the cavity as a consolidated pellet in accordance with the subject invention.
Figure 9:
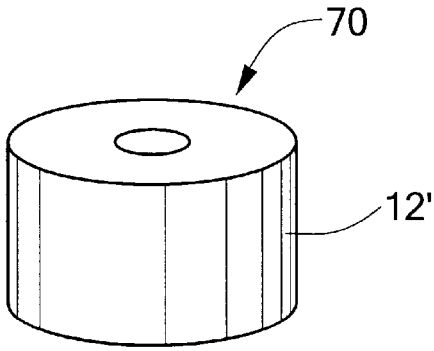
FIG. 9 is a schematic view showing how, in another embodiment of the subject invention, the charge is left in the cavity when, for example, the cavity is the opening in a detonator housing (e.g. a transistor can) portion of a detonator.

In one embodiment, wherein cavity 10, FIG. 1 is in female mold body 12, pellet 70, FIG. 8 can be removed therefrom for use in a detonator. In another embodiment, cavity 10, FIG. 1 is the opening in TO can 12', FIG. 9. In the latter example, dual charge 70, FIG. 7 is left in TO can 12' since it forms a part of a detonator when coupled with a TO header. See U.S. Pat. No. 6,158,347 incorporated herein by this reference.

In either embodiment, the method of this invention provides simultaneous consolidation of a dual load charge as shown in FIGS. 6–7. This method lowers the expense of the dual load charge detonator by using only a minimum amount of the expensive initiating charge powder and cuts the consolidation time in half by simultaneously consolidating both charges in a single consolidating pressing step. Also, a more robust charge is formed wherein the initiating charge is in intimate contact with the booster charge. The need for adhesives or mechanical fixtures previously used to couple to independently pressed pellets is thus eliminated. In another example, however, booster change 14, FIG. 4 is partially or completely consolidated by inner press 27, FIG. 3 and/or outer press 22.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims.

What is claimed is:

1. A method of manufacturing a dual load charge in a single consolidation pressing operation, the method comprising:

placing a first type explosive into a cavity to form a booster charge;

forming a pocket in the booster charge;

disposing a second type explosive in the pocket of the booster charge to form an initiating charge therein; and simultaneously consolidating both the booster charge and the initiating charge thereby forming a dual load charge with intimate contact between the booster charge and the initiating charge.

2. The method of claim 1 in which the cavity is in a detonator housing and the dual load charge is left in the cavity.

3. The method of claim 2 in which the cavity is the opening in a TO can.

4. The method of claim 1 in which the cavity is in a female mold member and the dual load charge is removed from the female mold member as a pellet.

5. The method of claim 1 in which the first type explosive is as octahydro-1,3,5,7-tetranitro-1,3,5,7-tetrazocine.

6. The method of claim 1 in which the second type explosive is 2,2',4,4',6,6'-Hexanitrostilbene.

7. A press for manufacturing a dual load charge in a single consolidation pressing operation, the press comprising:

an outer press having a working surface and a channel therethrough, the outer press receivable in a cavity;

a first inner press receivable in the channel of the outer press, the first inner press having a working surface which extends beyond the working surface of the outer press; and a second inner press receivable in the channel of the outer press, the second inner press having a working surface which is flush with the working surface of the outer press.

8. The press of claim 7 in which the outer press further includes a funnel-shaped portion in communication with the channel for loading the cavity with an explosive through the channel when the outer press is placed in the channel.

9. A method of manufacturing a dual load pellet in a single consolidation pressing operation, the method comprising:

placing a first type explosive into a cavity to form a booster charge;

forming a pocket in the booster charge by disposing an outer press having a working surface and a channel therethrough in the cavity in combination with a first inner press receivable in the outer press, the first inner press having a working surface which extends beyond the working surface of the outer press in order to form the pocket;

disposing a second type explosive in the pocket to form an initiating charge by removing the first inner press and pouring the second type explosive into the channel of the outer press; and simultaneously consolidating both the booster charge and the initiating charge thereby forming a dual load pellet with intimate contact between the booster charge and the initiating charge by placing a second inner press in the channel of the outer press, the second inner press having a working surface which is flush with the working surface of the outer press, and by applying pressure to the second inner press.

10. The method of claim 9 in which the cavity is in a detonator and the dual load charge is left in the cavity.

11. The method of claim 10 in which the cavity is the opening in a TO can.

12. The method of claim 9 in which the cavity is in a female mold member and the dual load charge is removed from the female mold member as a pellet.

13. The method of claim 9 in which the first type explosive is octahydro-1,3,5, 7-tetranitro-1,3,5,7-tetrazocine.

14. The method of claim 9 in which the second type explosive is 2,2',4,4',6,6'-Hexanitrostilbene.

15. The method of claim 9 in which the outer press includes a funnel-shaped portion in communication with the channel for loading the pocket with the second type explosive through the channel when the outer press is in place in the cavity.

16. A method of manufacturing a dual load charge, the method comprising:

placing a first type explosive into a cavity to form a booster charge;

forming a pocket in the booster charge;

disposing a second type explosive in the pocket of the booster charge to form an initiating charge therein; and consolidating both the booster charge and the initiating charge thereby forming a dual load charge with intimate contact between the booster charge and the initiating charge.

17. The method of claim 16 in which consolidating both the booster charge and the initiating charge occurs simultaneously.

18. A method of manufacturing a dual load pellet, the method comprising:

placing a first type explosive into a cavity to form a booster charge;

forming a pocket in the booster charge by disposing an outer press having a working surface and a channel therethrough in the cavity in combination with a first inner press receivable in the outer press, the first inner press having a working surface which extends beyond the working surface of the outer press in order to form the pocket;

disposing a second type explosive in the pocket to form an initiating charge by removing the first inner press and pouring the second type explosive into the channel of the outer press; and consolidating the initiating charge thereby forming a dual load pellet with intimate contact between the booster charge and the initiating charge by placing a second inner press in the channel of the outer press, the second inner press having a working surface which is flush with the working surface of the outer press, and by applying pressure to the second inner press.

19. The method of claim 18 in which consolidation of the booster charge occurs simultaneously with the consolidation of the initiating charge.

* * * * *